US005778994A

United States Patent [19]

Spatz

[11] Patent Number: 5,778,994

[45] Date of Patent: Jul. 14, 1998

[54] CLAW TOOTH ROTARY BIT

[75] Inventor: Edward C. Spatz, Dallas, Tex.

[73] Assignee: Dresser Industries, Inc., Dallas, Tex.

[21] Appl. No.: 902,095

[22] Filed: Jul. 29, 1997

[51] Int. Cl.[6] ..... E21B 10/00

[52] U.S. Cl. ..... 175/374; 175/425; 175/434

[58] Field of Search ..... 175/374, 420.1, 175/420.2, 425, 426, 428, 431, 434

[56] References Cited

U.S. PATENT DOCUMENTS

| | | | |
|---|---|---|---|
| 4,109,737 | 8/1978 | Bovenkerk . | |
| 4,262,761 | 4/1981 | Crow . | |
| 4,629,373 | 12/1986 | Hall . | |
| 4,630,692 | 12/1986 | Ecer . | |
| 4,705,124 | 11/1987 | Abrahamson et al. . | |
| 4,726,432 | 2/1988 | Scott et al. . | |
| 4,726,718 | 2/1988 | Meskin et al. . | |
| 4,784,023 | 11/1988 | Dennis . | |
| 4,944,774 | 7/1990 | Keshavan et al. | 175/426 X |
| 4,951,762 | 8/1990 | Lundelz | 175/420.1 |
| 5,027,912 | 7/1991 | Juregens . | |
| 5,120,327 | 6/1992 | Dennis . | |
| 5,152,194 | 10/1992 | Keshavan et al. . | |
| 5,159,857 | 11/1992 | Jurewicz . | |
| 5,217,081 | 6/1993 | Waldenstrom et al. | 175/420.2 |
| 5,351,769 | 10/1994 | Scott et al. . | |
| 5,379,854 | 1/1995 | Dennis . | |
| 5,445,231 | 8/1995 | Scott et al. | 175/426 X |
| 5,499,688 | 3/1996 | Dennis | 175/426 |

*Primary Examiner*—Roger J. Schoeppel
*Attorney, Agent, or Firm*—Browning Bushman

[57] ABSTRACT

A claw tooth rotary bit having teeth that are constructed from a hard material that is combined with a softer material so that the teeth wear unevenly as the bit is used to bore through an earth formation. Adjacent teeth may be provided with complementary patterns of hard and soft material shapes. Two adjacent teeth form a set that wear in a complementary pattern such that the high points of one tooth register with the low points of the adjacent tooth. As the bit rotates, the formation is randomly engaged by the high and low areas on the teeth to increase cutting effectiveness. The alternating layers of hard and soft material provide a self-sharpening configuration as the teeth wear unevenly. The presence of the hard material in the tooth structure improves tooth rigidity. In a preferred form, the hard material is a polycrystalline diamond while the softer material is steel.

21 Claims, 2 Drawing Sheets

CLAW TOOTH ROTARY BIT

BACKGROUND OF THE INVENTION

Field of the Invention

The present invention relates generally to the tooth structure of rotary bits used to bore through earthen formations. More specifically, the present invention relates to a new and improved tooth design for rotary bits in which dissimilar materials are combined to enhance the durability and penetrating capability of a rotary drill bit.

Description of the Prior Art

The design and composition of rotary bit teeth have undergone evolutionary changes that have significantly improved the life and penetration rates of rotary drill bits. Tooth contour, hard facing, tooth positioning, and orientation on the bit, material composition, and other variables have been adjusted in small increments that have frequently resulted in significant improvements in bit performance. Advances in metallurgy have also made it possible to create and physically combine materials in a way not previously possible, resulting in sometimes dramatic improvement in the durability and performance characteristics of the bit. Significant bit improvement was recognized with the introduction of superhard facing materials, such as polycrystalline diamond compact structures.

For some applications, the improved design or construction is accompanied by a significantly increased cost that cannot be justified based on the level or nature of the improvements obtained. In such situations, it may be less expensive to replace a worn bit or extend the drilling time than it is to employ a better performing, but more costly, bit. Accordingly, the importance of design and material changes that produce improved rate of penetration and bit life must be measured against the cost of building a bit incorporating the changes.

It is recognized in the prior art that spalling and chipping of superhard cutter facings can be reduced by rounding or chamfering the edges of the facings. See, for example, U.S. Pat. No. 5,437,343 to Cooley, et al., which describes specific chamfer configurations that are machined on a cutting element to provide increased fracture resistance.

It is also recognized that reinforcing the layer of superhard material with a suitable underlying tooth material can also improve the fracture resistance of the superhard material. See, for example, U.S. Pat. No. 4,109,737 to Bovenkerk that describes various support bodies for bit cutting elements having overlying hard material facings. These configurations result from the use of special fabrication techniques to apply the superhard material in a controlled pattern to a specially shaped support body.

The prior art has also disclosed a variety of methods for bonding superhard facing material to a bit insert to prevent delamination of the facing material. See, for example, U.S. Pat. Nos. 4,784,023 to Dennis and 4,972,637 to Dyer. Both of these latter patents also disclose the concept of bit wear producing multiple cutting edges in the cutting element that is attached to a supporting body or carrier. The cutting edges of the cutting element are formed as the dissimilar materials in the cutting element unevenly wear away during usage. All of the previously cited prior art patents relate to cutting teeth in which special cutting surfaces are mounted on a supporting stud or other carrier element where the stud or carrier element is not intended as a normal part of the cutting surface of the bit. In these prior art designs, the bit life is essentially exhausted when the cutting surfaces wear to the supporting carrier.

Summary of the Invention

Some or all of the cutting elements of a conventional bit are provided with layers of hard material in a defined pattern that extends substantially through the entire body of the cutting element. In the layered elements, the layers of hard material extend away from the bit body and are spaced laterally from each other by layers of softer bit material. Normal bit rotation through the formation eventually wears away the hard material to gradually expose the layered soft and hard materials. The hard material thus protects the softer metal core of the tooth when wear begins at the crest of the tooth. Moreover, because the hard material wears at a rate that is slower than the main cutter body material, alternating grooves and ridges are formed in the cutting profile of the cutter. The wearing away process also has the effect of chamfering the edges of the hard material. The close lateral support of the softer bit material along the side of the hard material provides structural strength to the hard layer to further resist fracturing. By extending the hard layers substantially through the full lengths of the cutter element, the rigidity of the cutter is improved, and the effective cutting length of the tooth is increased.

The bit design of the present invention provides longer tooth life and tooth integrity, which are particularly beneficial in directional drilling and drilling in anisotropic formations.

In one embodiment of the invention, adjacent teeth are provided with differing patterns of softer bit material and superhard cutter material so that the resulting wear pattern in adjacent teeth is different. In a preferred form, the adjacent patterns form complements to each other so that the wear groove of one tooth is in the same relative position as the wear crest in an adjacent tooth. In such a configuration, as the bit is rotated, the crest of a cutter is randomly forced into engagement with the crest of a formation cut by one or more preceding teeth so that maximum cutting interference occurs between the rotating bit and the formation, resulting in an increased rate of penetration.

In another embodiment of the invention adjacent teeth are provided with the same pattern of hard and soft materials extending substantially through the full length of the cutter element. Even though adjacent teeth develop similar wear patterns, interference between cutter profiles and formation cuts is also enhanced since adjacent teeth in the bit cone traverse different paths as they roll or drag against the formation.

Another embodiment of the invention alternates layered teeth with standard, hardsurfaced teeth to form yet another pattern of cutter profiles that also seeks to optimize interference with the profile of the cutaway formation.

Selection of the tooth arrangement to provide the best bit performance may be dictated by the type of formation to be bored. Thus, for certain formations, a tooth configuration in which layered materials in the teeth produce complementary wear patterns in adjacent teeth may optimize bit life or rate of penetration, or both. In other formations, a bit having normal bit teeth alternating with wear patterned teeth or a bit employing only a single pattern of alternating hard and soft material may produce superior results.

From the foregoing, it will be appreciated that an object of the present invention is to economically build a bit having improved penetration and life using an improved tooth construction in an established, conventional bit design.

Another object of the invention is to employ conventional bit tooth materials in a novel arrangement to improve bit performance.

Still another object of this invention is to combine dissimilar bit tooth materials using conventional material combining techniques to provide an improved tooth design that can increase the rate of penetration and life of a conventional bit.

Yet another object of this invention is to provide a self-chamfering bit design that can reduce spalling and chipping in superhard materials incorporated into a bit tooth.

An important object of the present invention is to provide a bit tooth that is constructed of dissimilar materials layered together through substantially the entire tooth profile to increase the bit life.

A related object of the invention is provide a bit tooth design in which softer bit tooth material adjacent superhard material provides lateral support to the superhard material throughout the wear life of the tooth to minimize fracturing of the superhard material.

Another object of the invention is to make a bit in which adjacent teeth are constructed with different patterns of adjoined dissimilar materials to produce different tooth profiles as the teeth wear whereby the crests of the earthen formation left in the cut of one tooth are randomly engaged by the crest of another tooth on succeeding teeth to optimize bit penetration.

Yet another object of the present invention is to provide a bit in which adjacent teeth follow different paths through the formation and have similar patterns of adjoined dissimilar materials extending substantially through the tooth bodies whereby similar wear patterns of multiple crests and valleys are formed in adjacent teeth.

It is also an object of the present invention to alternate normal, hardsurfaced, homogeneous bit teeth with teeth formed of dissimilar materials layered together through substantially the entire tooth profile to produce a formation contact surface as the bit teeth wear that optimizes interference between the bit and the formation as the bit is rotated.

These and further objects, features, and advantages of the present invention will become apparent from the following description, wherein reference is made to the figures in the accompanying drawings.

DETAILED DESCRIPTION OF THE PREFERRED EMBODIMENTS

Figure 1:
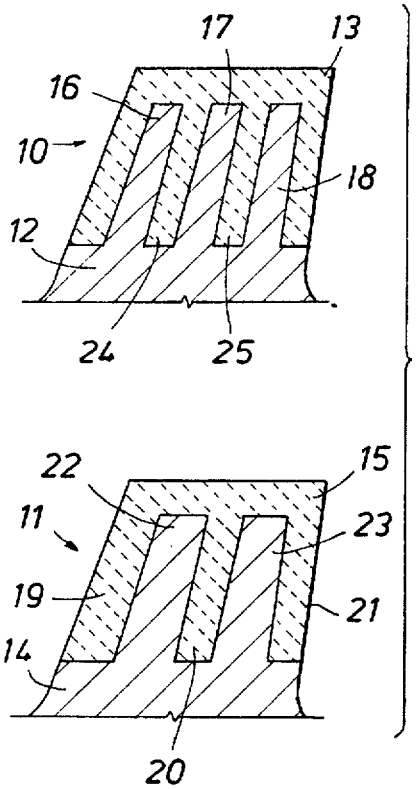
FIG. 1 is a vertical section, broken away, illustrating complementary geometric patterns of hard and soft material in an adjacent bit tooth set.
Figure 3:
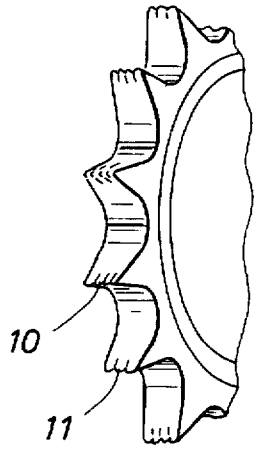
FIG. 3 is a perspective view of a portion of a rotary bit equipped with the claw tooth design of the present invention.

FIG. 1 illustrates a pair of adjacent teeth indicated generally at 10 and 11 that may be employed, for example, on a conventional rolling cone rock bit. Such a cone is schematically illustrated in FIG. 3.

The tooth 10 is constructed of a main body section 12 and a harder material section 13. The tooth 11 is similarly constructed with a main body section 14 and a harder material section 15. The main body 12 includes radially extending tooth body sections 16, 17, and 18. Complementary, radially extending sections of harder material 19, 20, and 21 are provided on the tooth 11. The tooth 11 is also equipped with radially extending main body sections 22 and 23 that are geometric complements to hard material radial extensions 24 and 25 of the tooth 10.

Figure 2:
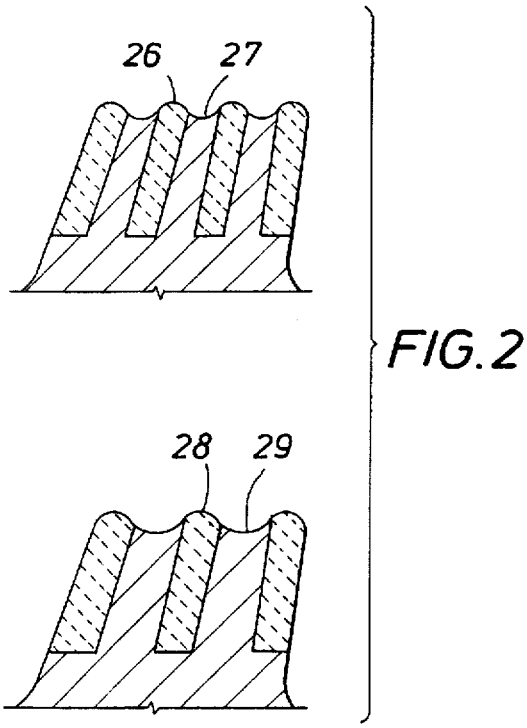
FIG. 2 is a view similar to FIG. 1 illustrating the wear pattern of the tooth set of FIG. 1.

As thus illustrated, it will be appreciated that the main body pattern of the tooth 10 comprised of the sections 16, 17, and 18 functions as a geometric complement to the hard material sections 19, 20, and 21 of the tooth 11. Each tooth includes a crest and side faces with the hard material extending from the crest into the main tooth body between the side faces. As the crest wears away, the main tooth body is exposed so that the resulting wear area produces a cutting profile, as illustrated in FIG. 2. This complementary relationship is further defined by the travel of the teeth 10 and 11 during the rotary boring operation. In this regard, if the tooth 10 leads the tooth 11 during rotary boring, the tooth 11 will not follow the same contact path as the tooth 10, but other teeth in the same cone will engage the same contact point. The provision of different cut patterns on the teeth increases the probability of a tooth ridge striking a formation ridge to increase the interference between the bit and formation on any given full revolution of the bit.

When the hard material covering of the tooth has worn away, the worn tooth begins to wear unevenly, as indicated in FIG. 2. At this point, it may be appreciated that the hard material 13 wears less quickly than the softer material of the main body 12, producing a series of crests and grooves such as the crest 26 and grove 27 of the tooth 10 and the crest 28 and groove 29 of the tooth 11.

FIG. 3 illustrates the rotary cone bit after it has been worn through use. As may be seen, the tooth 11 is left with a profile having three crests while the adjacent tooth 10 is left with a profile having four crests. This pattern is repeated around the cone. In this way, the teeth 10 and 11 work as a complementary set to produce differing cut patterns at each contact point where they engage the formation.

Figure 4:
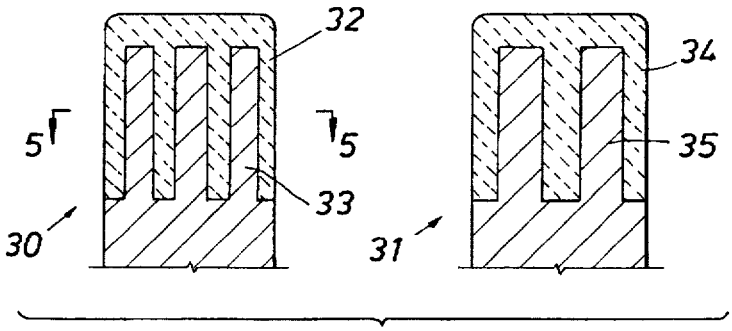
FIG. 4 is a vertical section, partially broken away, illustrating adjacent cylindrical insert teeth having complementary geometric hard and softer metal patterns.
Figure 5:
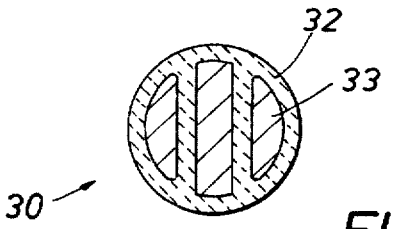
FIG. 5 is a horizontal section taken along 5–5 of FIG. 1 illustrating the softer material pattern contained within the harder material pattern of the cylindrical insert.

FIG. 4 illustrates an insert-type tooth equipped with the alternating hard and softer material construction of the present invention. The tooth set of FIG. 4 includes a tooth 30 and adjacent tooth 31. The teeth 30 and 31 are adapted to be received in a bore formed in a bit body in a conventional manner. As with the embodiment of FIGS. 1–3, the tooth form of FIG. 4 may be employed in any suitable conventional bit configuration. Complementary geometric patterns are formed in the adjacent teeth 30 and 31 by the combined construction of hard material and softer material in the main tooth body. Thus, in the construction of the tooth 30, hard material 32 overlies and is interspersed within the softer material 33. Similarly, in the tooth 31, hard material 34 is interspersed in the softer body material 35. The pattern of the soft material and hard material configuration is illustrated in more detail in FIG. 5. As with the previously described embodiment of FIGS. 1–3, the tooth set 30 and 31 wears to form different tooth profiles that maximize the interference of the teeth with the formation and provide self-sharpening as the dissimilar wear occurs. Presence of the hard material within the softer body material also increases tooth rigidity to further increase bit penetration into the formation.

Figure 6:
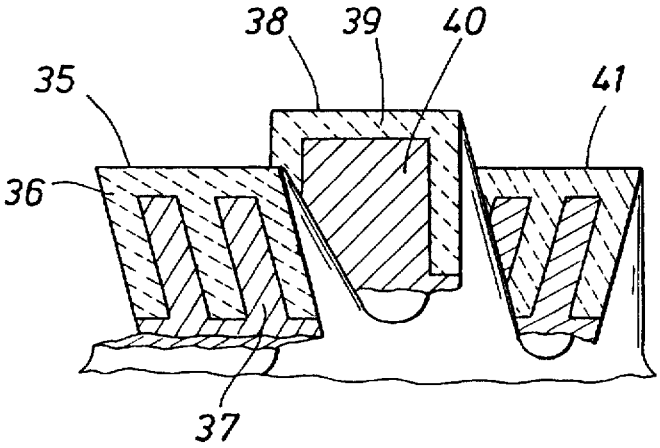
FIG. 6 is a schematic representation of alternating layered composite material teeth and conventional homogeneous material teeth.
Figure 7:
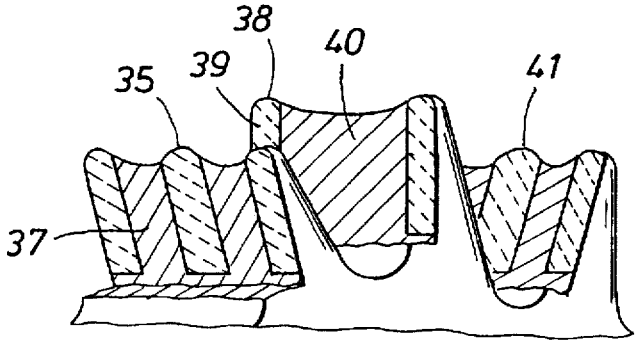
FIG. 7 is a view similar to FIG. 6 illustrating the wear pattern of the tooth set of FIG. 6.
Figure 8:
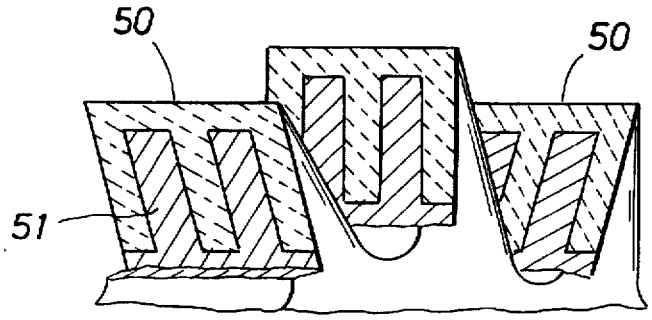
FIG. 8 is a schematic representation of adjacent bit teeth having similar layered composite material configurations.

While the previous invention has been specifically described for use in rotary cone bit applications, it will be appreciated that the invention has broader application and may be employed in any bit that produces increased performance through increased interference between bit tooth and formation profile and through increased tooth rigidity and self-sharpening. It will further be appreciated that while the invention has been described with teeth having alternating, complementary geometric hard material patterns, benefits of the described invention can be obtained in a bit wherein the patterns are essentially the same in adjoining teeth. In such applications, if the bit action produces interference with the formation as a result of prior tooth cutting, the benefits of the dissimilar wear and self-sharpening and rigidity features of the invention are also attained. FIGS. 6–8 illustrate variations in the configuration and wear patterns of bit teeth of the present invention. FIG. 6 illustrates an unworn rolling bit having a first tooth 35 with a hard material 36 covering the softer bit material 37. The softer material projects through the tooth away from the bit body (not illustrated) in layers that are laterally positioned between the hard material layers. The hard and soft materials are bonded to each other along their interfacing contact areas. The bonded union may be produced by any conventional technique employed for securing dissimilar bit tooth materials to each other.

An adjacent tooth 38 is provided with an outer layer 39 of hard material that covers an inner, softer material section 40 of the bit body. A tooth 41 is configured like the tooth 35. The sequence of tooth material patterns is repeated around the roller. FIG. 7 illustrates the wear pattern of the roller illustrated in FIG. 6.

Figure 9:
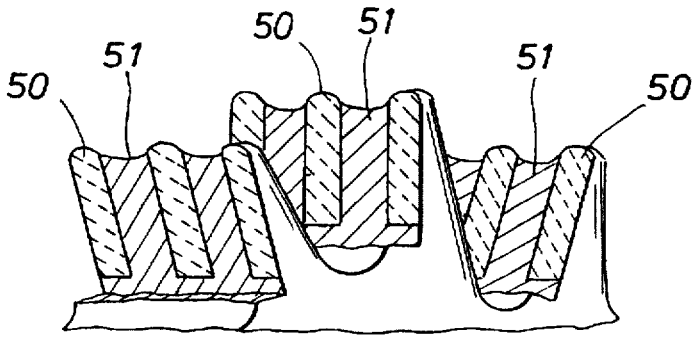
FIG. 9 is a view similar to FIG. 8 illustrating the wear pattern of the tooth set of FIG. 8.

FIG. 8 illustrates a modified material layering pattern for bit teeth in which a hard outer material layer 50 is disposed over softer bit body material 51. The pattern is similar for all teeth on the roller. FIG. 9 illustrates the wear pattern of the roller of FIG. 8.

While the hard material of the invention has been described as a polycrystalline diamond, it will be appreciated that other materials that are hard compared to the main tooth body may also advantageously be employed in the present invention. It will also be appreciated that the polycrystalline diamond of the tooth structure may take the form of synthetic diamond wedges. Similarly, the underlying body need not be steel but can be another material, softer than the hard material, and still provide the benefits of the present invention.

While the invention has been illustrated and described with reference to certain preferred embodiments thereof, it will be apparent to those skilled in the art that modifications, substitutions, additions, and deletions may be made without departing from the spirit and the scope of the invention as defined in the appended claims.

What is claimed is:

1. A bit for boring earthen formations comprising:

a bit body;

teeth extending from said bit body;

said teeth including a main body section and a hard material section;

said hard material section being comprised of a material having a wear characteristic different than the wear characteristic of the material comprising said main body section; and said hard material section combining in a first pattern with a first one of said teeth and combining in a second, different pattern with a second one of said teeth immediately adjacent to said first tooth whereby said first and second teeth comprise a tooth set of two teeth that wear dissimilarly while boring.

2. The bit as defined in claim 1, wherein said first and second patterns are substantially geometric complements to each other whereby said first and second teeth of said set wear in complementary patterns.

3. The bit as defined in claim 1, wherein said main body section is comprised of steel and said hard material section is comprised of a polycrystalline diamond material.

4. The bit as defined in claim 1, wherein each of said teeth includes a crest and side faces, and said hard material is positioned over said crest and said side faces and extends from said crest into said main body between said side faces whereby when said crest wears away, said main body and said hard material are adjacent each other in a wear area of said tooth to form a cutting interface.

5. The bit as defined in claim 1, further including a plurality of tooth sets extending from said bit body.

6. The bit as defined in claim 1, wherein said main body sections of said teeth are integrally formed with said bit body.

7. The bit as defined in claim 1, wherein said main body sections of said teeth are separably formed from said bit body and are secured to said bit body.

8. The bit as defined in claim 1, wherein said first pattern comprises at least two laterally spaced, non-central areas of penetration of hard material into said main body of said first tooth and said second pattern comprises a central area of hard material penetration into said main body of said second tooth.

9. The bit as defined in claim 1, wherein said bit is a roller cone bit.

10. The bit as defined in claim 7, wherein said bit is a roller cone bit.

11. A method of making bit teeth for a rotary bit body, comprising the steps of:

alternating hard and soft material in a first bit tooth to form a first wear pattern;

alternating hard and soft material in a second bit tooth to form a second wear pattern, different from said first pattern; and positioning said first and second bit teeth on said bit body relative to each other and to the direction of the bit rotation such that said first and second wear patterns are substantial complements to each other in the direction of bit rotation.

12. The method as defined in claim 11, wherein said hard material comprises a polycrystalline diamond material and said soft material comprises steel.

13. The method as defined in claim 11, wherein said teeth extend radially away from said bit body and said first bit pattern comprises at least one radially extending soft material section and said second pattern comprises at least two radially extending soft material sections spaced laterally from said soft material section of said first pattern.

14. The method as defined in claim 11, wherein said first and second bit teeth are inserted into said bit body.

15. The method as defined in claim 11, wherein said first and second teeth are integrally formed with said bit body.

16. The method as defined in claim 13, wherein said first and second teeth are integrally formed with said bit body.

17. A claw tooth bit for boring through an earthen formation, comprising:

a bit body;

a plurality of cutting elements, each such cutting element having an elongate body carried by said bit body and extending away from said bit body; and alternating, laterally spaced, layers of materials having different wear characteristics layered in said elongate bodies of said cutting elements and extending substantially the full body length of said cutting elements whereby wear of said cutting elements during boring produces alternating peaks and valleys in the formation contacting surface of said cutting elements.

18. The claw tooth bit as defined in claim 17, wherein said alternating layers are comprised of steel and polycrystalline diamond.

19. The claw tooth bit as defined in claim 17, further including plural claw tooth patterns, such patterns having alternating layers of materials disposed in variable arrangements with differing patterns on said cutting elements whereby said cutting elements wear to produce alternating peaks and valleys in differing relative positions in their respective formation contacting surfaces.

20. The claw tooth configuration as defined in claim 19, wherein said alternating layers of materials comprise steel and polycrystalline diamond.

21. The claw tooth configuration as defined in claim 17, wherein said layers include synthetic diamond wedges.

* * * * *